US008368482B2

(12) United States Patent
Sano

(10) Patent No.: US 8,368,482 B2
(45) Date of Patent: Feb. 5, 2013

(54) DIELECTRIC WAVEGUIDE-MICROSTRIP TRANSITION INCLUDING A CAVITY COUPLING STRUCTURE

(75) Inventor: Kazuhisa Sano, Tsurugashima (JP)

(73) Assignee: Toko, Inc., Saitama (JP)

( * ) Notice: Subject to any disclaimer, the term of this patent is extended or adjusted under 35 U.S.C. 154(b) by 243 days.

(21) Appl. No.: 12/637,300

(22) Filed: Dec. 14, 2009

(65) Prior Publication Data

US 2010/0148891 A1 Jun. 17, 2010

(30) Foreign Application Priority Data

Dec. 12, 2008 (JP) ..... 2008-316570

(51) Int. Cl.
*H01P 5/107* (2006.01)

(52) U.S. Cl. ..... 333/26; 333/248; 333/125

(58) Field of Classification Search ..... 333/26, 333/248, 125, 137
See application file for complete search history.

(56) References Cited

U.S. PATENT DOCUMENTS

| | | | | |
|---|---|---|---|---|
| 5,726,664 | A * | 3/1998 | Park et al. | 343/705 |
| 5,912,598 | A | 6/1999 | Stones et al. | |
| 6,081,241 | A * | 6/2000 | Josefsson et al. | 343/771 |
| 6,486,748 | B1 * | 11/2002 | Stones et al. | 333/26 |
| 6,614,332 | B2 * | 9/2003 | Yamashita et al. | 333/239 |
| 6,677,837 | B2 * | 1/2004 | Kojima et al. | 333/208 |
| 7,132,905 | B2 | 11/2006 | Sano | |
| 2002/0097109 | A1 * | 7/2002 | du Toit et al. | 333/26 |

FOREIGN PATENT DOCUMENTS

| | | |
|---|---|---|
| EP | 1 530 251 | 5/2005 |
| EP | 1 986 265 | 10/2008 |
| FR | 2 869 723 | 11/2005 |
| JP | 08-148913 | 6/1996 |
| JP | 10-107518 | 4/1998 |
| JP | 2000-252712 | 9/2000 |
| JP | 3493265 | 11/2003 |
| JP | 3517148 | 1/2004 |
| JP | 2005-027128 | 1/2005 |
| JP | 2005-142884 | 6/2005 |
| JP | 4133747 | 6/2008 |
| WO | WO 97/44851 | 11/1997 |
| WO | WO 98/54782 | 12/1998 |

* cited by examiner

*Primary Examiner* — Benny Lee
(74) *Attorney, Agent, or Firm* — Cozen O'Connor

(57) ABSTRACT

In a dielectric waveguide-microstrip transition structure for mounting a dielectric waveguide on a printed-wiring board, one object of the present invention is directed to providing a further downsized structure as compared with a conventional structure, while maintaining an influence of displacement between the dielectric waveguide and the microstrip at a low level by means of non-contact coupling. The dielectric waveguide-microstrip transition structure has a dielectric waveguide containing a dielectric block and a conductor film covering an entire surface of the dielectric block, except a signal input/output portion, wherein a slot is formed in a bottom surface of the dielectric waveguide to expose the dielectric; a microstrip having an end which is openly terminated and disposed with opposing to and spaced apart from the slot of the dielectric waveguide; and a cavity containing a conductive wall surrounding the end of the microstrip and the slot of the dielectric waveguide, except a part of the microstrip being led out to connect to an external circuit.

4 Claims, 5 Drawing Sheets

DIELECTRIC WAVEGUIDE-MICROSTRIP TRANSITION INCLUDING A CAVITY COUPLING STRUCTURE

RELATED APPLICATIONS

This application claims the priority of Japanese Application No. 2008-316570 filed Dec. 12, 2008, the entire content of which is hereby incorporated by reference.

FIELD OF THE INVENTION

The present invention relates to a dielectric waveguide-microstrip transition structure for mounting a dielectric waveguide on a printed-wiring board formed with a microstrip line, and a branch circuit using the transition structure.

BACKGROUND OF THE INVENTION

As a structure for mounting a dielectric waveguide on a printed-wiring board, there has been known one type disclosed, for example, in JP 4133747B. This mounting structure is configured such that a coupling electrode pattern formed on a bottom surface of a dielectric waveguide, and a coupling electrode pattern formed on a terminal end of a microstrip, are accommodated within a cavity in opposed relation to each other while providing an air gap therebetween by a spacer, so as to produce electromagnetic coupling therebetween to allow high-frequency energy to be transmitted between the microstrip and the dielectric waveguide.

In the conventional mounting structure, a conductor pattern of the microstrip is in non-contact with a conductor pattern of the dielectric waveguide, which provides an advantage of being able to perform stable energy transmission without suffering from a contact state between the conductor patterns.

However, the conventional mounting structure requires a relatively long dimension value. For example, in the case where the conventional mounting structure is designed on an assumption that a dielectric waveguide having a cross-sectional area of 4.5 mm×2.5 mm is fabricated using a dielectric material with a relative permittivity (dielectric constant) of 4.5, and transition is performed in a frequency band of 23 to 28 GHz, a length of a conductor pattern to be provided on a bottom surface of the dielectric waveguide is set to 6.6 mm. Considering that a guide wavelength of an electromagnetic wave in a TE mode to be propagated through the dielectric waveguide is 9.7 mm at 23 GHz and 6.5 mm at 28 GHz, respectively, a ratio of the length to the guide wavelength is in the range of about 0.7 to 1. It is desired to maximally downsize a dielectric waveguide as a component to be mounted on a printed-wiring board. Thus, it is a critical challenge to achieve a further downsized mounting structure.

SUMMARY OF THE INVENTION

In a dielectric waveguide-microstrip transition structure for mounting a dielectric waveguide on a printed-wiring board, one object of the present invention is directed to providing a further downsized structure as compared with the conventional structure using the coupling electrode patterns, while maintaining an influence of displacement between the dielectric waveguide and the microstrip at a low level by means of non-contact coupling.

According to one aspect of the present invention, there is provided a dielectric waveguide-microstrip transition structure which has a dielectric waveguide containing a dielectric block and a conductor film covering an entire surface of the dielectric block, except a signal input/output portion, wherein a slot is formed in a bottom surface of the dielectric waveguide to expose the dielectric; a microstrip having an end which is openly terminated and disposed with opposing to and spaced apart from the slot of the dielectric waveguide; and a cavity containing a conductive wall surrounding the end of the microstrip and the slot of the dielectric waveguide, except a part of the microstrip being led out to connect to an external circuit.

In a preferred embodiment of the present invention, a slot is formed in a bottom surface of a dielectric waveguide. A microstrip is formed on a printed-wiring board for allowing the dielectric waveguide to be mounted thereon, to have an end openly terminated. The dielectric waveguide is mounted on the printed circuit board in such a manner that the slot formed in the bottom surface of the dielectric waveguide is disposed adjacent to and in non-contact with the microstrip with a given distance therebetween.

A conductive wall is provided to define a cavity so as to accommodate the slot and the end of the microstrip therewithin. A portion of the conductive wall crossing the microstrip (microstrip line) is partially removed to allow the microstrip to pass therethrough. The conductive wall is also provided along an outer peripheral edge of an electromagnetic coupling region of the printed-wiring board (printed-circuit board) to define the cavity in cooperation with a top surface of the printed-wiring board and the bottom surface of the dielectric waveguide.

In the dielectric waveguide-microstrip transition structure of the present invention, the terminal end of the microstrip and the slot in the bottom surface of the dielectric waveguide are disposed in adjacent relation to each other to achieve electromagnetic coupling therebetween, so that high-frequency energy can be transmitted between the microstrip and the dielectric waveguide. The electromagnetic coupling region is accommodated within the cavity to minimize leakage and loss of electromagnetic energy. In addition, only an air layer is interposed in the electromagnetic coupling region, i.e., no substance causing energy loss exists therein, so that energy loss becomes lower.

The coupling (transition) structure has no physical contact. This makes it possible to prevent degradation in transmission characteristic due to displacement during mounting, without suffering from a contact state between the dielectric waveguide and the microstrip, and moderate a requirement for positioning accuracy of the dielectric waveguide. The conventional coupling electrode pattern is required to have a longitudinal length approximately equal to a guide wavelength, as mentioned above. In contract, an electrode pattern to be provided in the dielectric waveguide is only a slot having a minimum size, so that the transition structure can be downsized in its entirety.

DETAILED DESCRIPTION OF THE DRAWINGS

Figure 1:
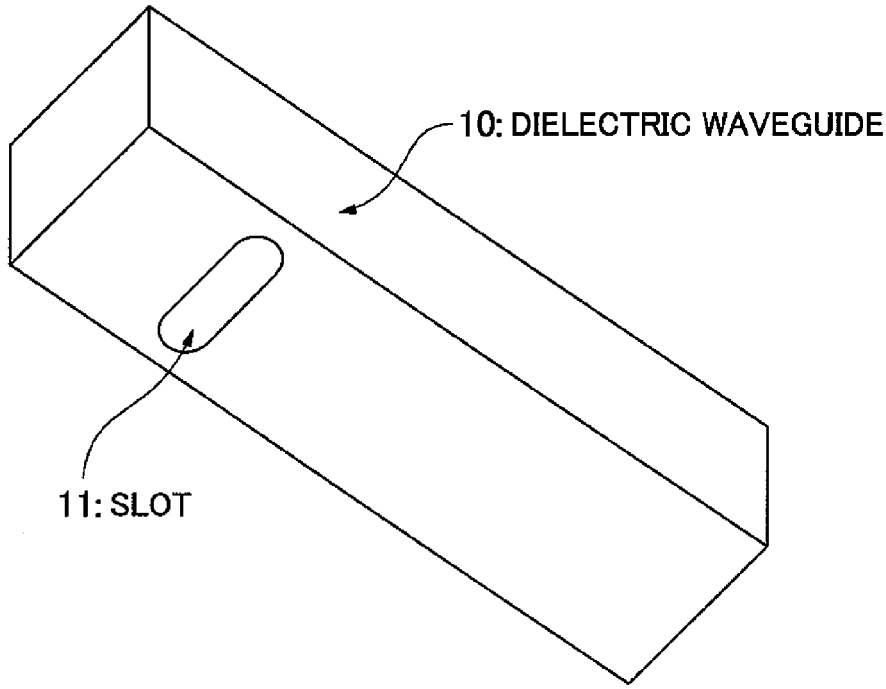
FIG. 1 is a perspective view showing a dielectric waveguide for use in a dielectric waveguide-microstrip transition structure according to a first embodiment of the present invention.

With reference to the drawings, the present invention will now be described based on an embodiment thereof. FIG. 1 is a perspective view of a dielectric waveguide 10 for use in a dielectric waveguide-microstrip transition structure according to a first embodiment of the present invention. As shown in FIG. 1, a slot 11 is formed in a bottom surface of the dielectric waveguide to extend in a direction perpendicular to a traveling direction of an electromagnetic wave. The dielectric waveguide comprises a dielectric block, and a conductor film formed to expose only a region of a surface of the dielectric block corresponding to the slot 11, and fully cover the remaining region.

Figure 2:
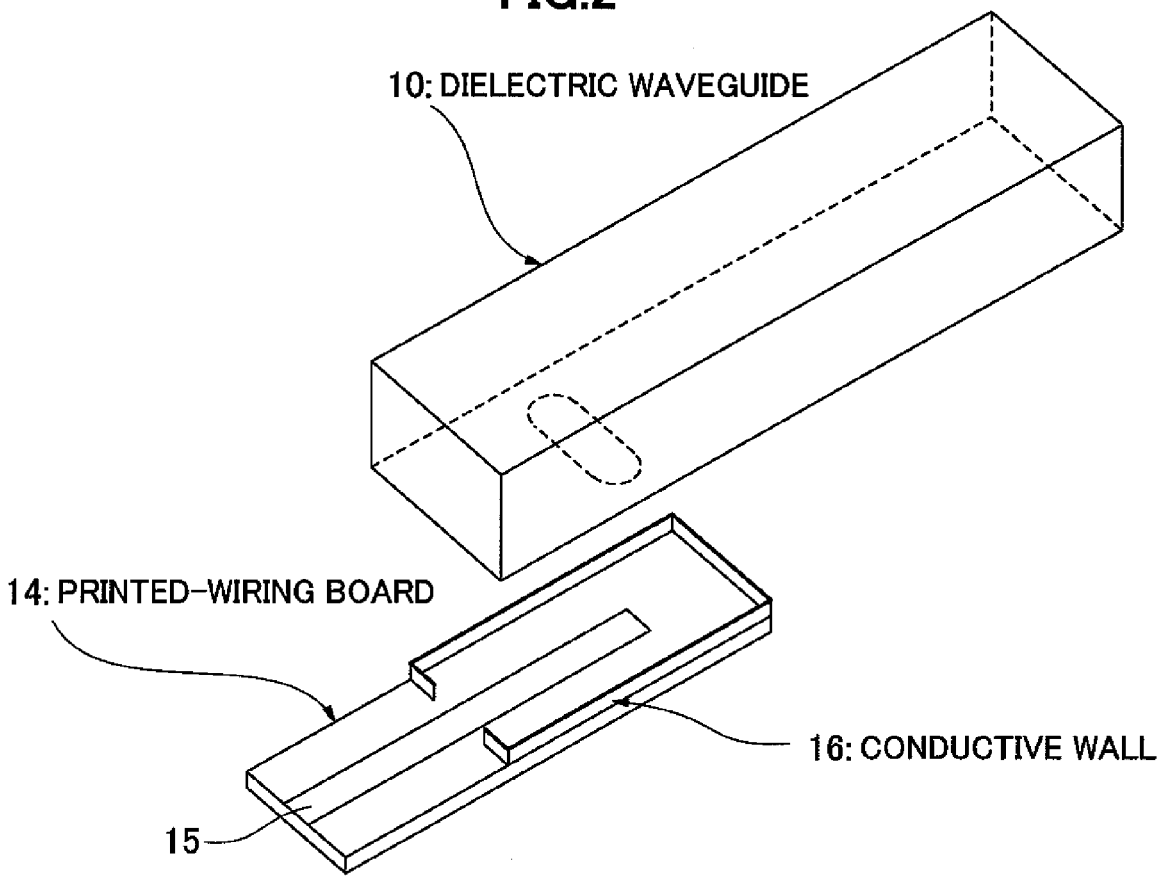
FIG. 2 is an exploded perspective view showing the transition structure according to the first embodiment.

As shown in FIG. 2, the dielectric waveguide 10 is mounted on a printed-wiring board 14. A microstrip 15 is provided on the printed-wiring board to have an end which is terminated in an open circuit, and disposed in opposed relation to the bottom surface of the dielectric waveguide with a given distance therebetween. Further, a conductive wall 16 is provided around the opposed region of the printed-wiring board, and the printed-wiring board 14 is closely fixed to the dielectric waveguide 10 through an interspace created by the conductive wall 16.

The microstrip 15 and the dielectric waveguide 10 are electromagnetically coupled together through respective conductor patterns thereof to allow an electromagnetic wave to be transmitted therebetween. As for a positional relationship between the slot 11 and the microstrip 15, the slot 11 is disposed at a position away from an edge of the open terminal end of the microstrip 15 by a distance of about a quarter wavelength, i.e., a position where an electromagnetic field intensity is maximized, to obtain a sufficient coupling. Although a maximum electromagnetic field intensity is theoretically provided at a position away from the edge of the open terminal end by a distance of a quarter wavelength, the distance actually becomes shorter than a quarter wavelength due to an edge effect of the open terminal end of the microstrip 15. Further, as for a position where the slot 11 is formed in the bottom surface of the dielectric waveguide 10, an electromagnetic field intensity is maximized at a position away from a short-circuited terminal end of the dielectric waveguide 10 by a distance of about a half wavelength. Thus, the slot 11 is formed at this position.

In high-frequency energy transmission, a discontinuous region as a coupling region of a transmission line is apt to cause large radiation loss and significant degradation in transmission characteristics. The coupling (transition) structure in the first embodiment is configured to accommodate the discontinuous region within the cavity defined by the conductive wall to minimize radiation of an electromagnetic field to exterior space.

Figure 3:
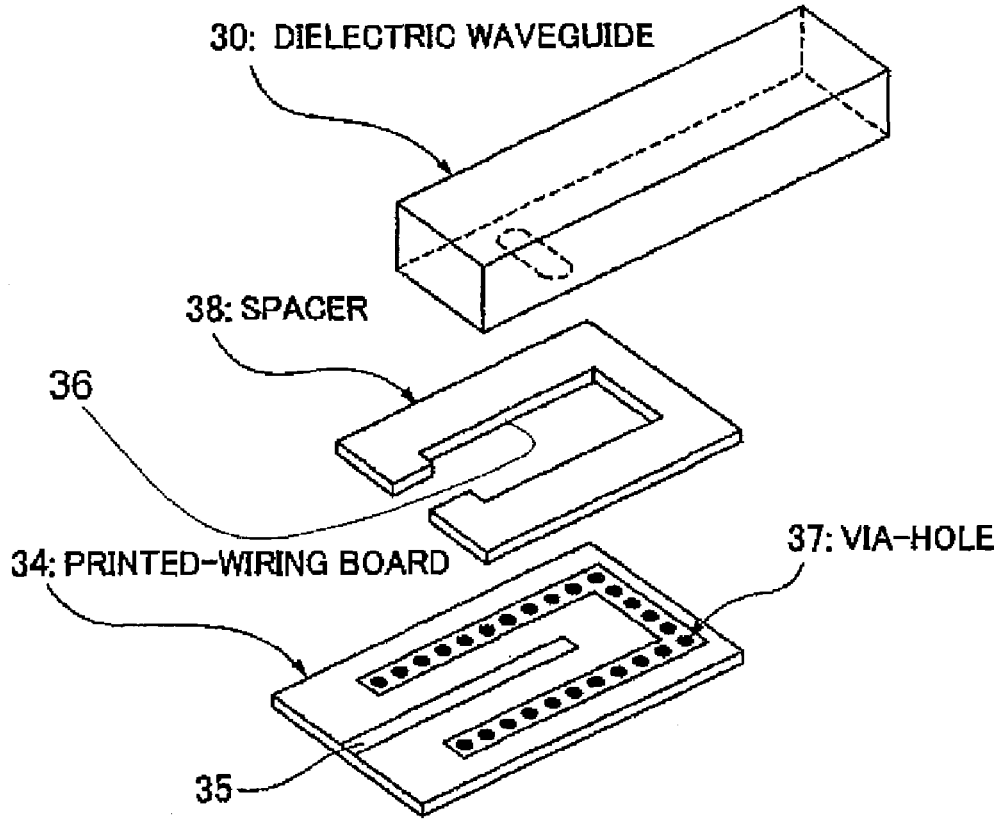
FIG. 3 is an exploded perspective view showing a dielectric waveguide-microstrip transition structure according to a second embodiment of the present invention.
Figure 4:
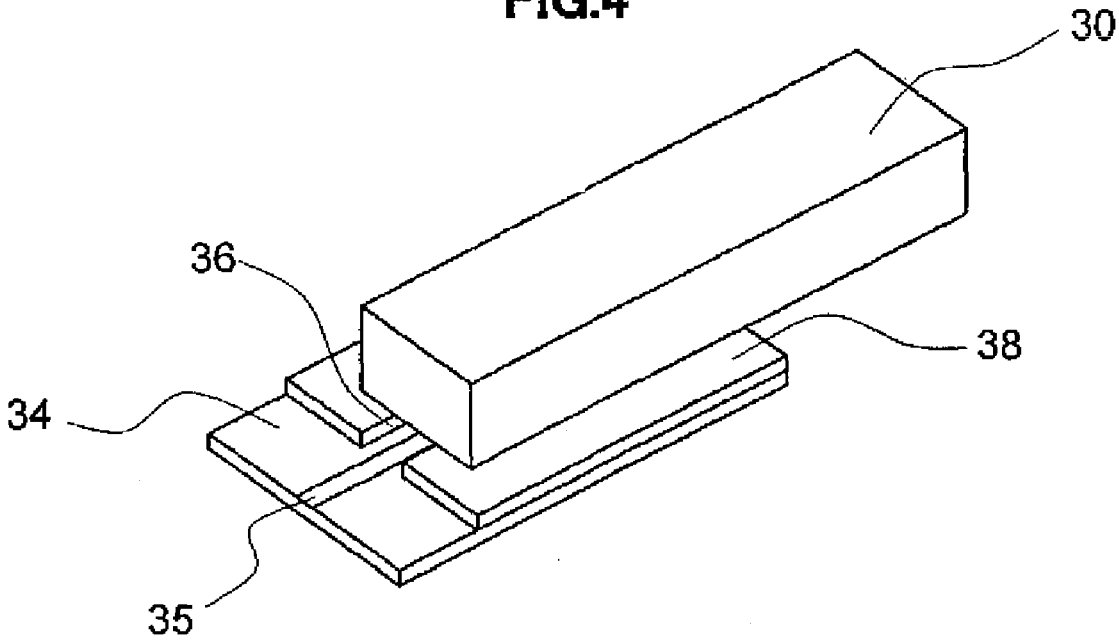
FIG. 4 is a perspective view showing the dielectric waveguide-microstrip transition structure according to the second embodiment.

FIG. 3 is an exploded perspective view showing a dielectric waveguide-microstrip transition structure according to a second embodiment of the present invention. FIG. 4 shows the transition structure in an assembled state. As shown in FIG. 3, an array of via-holes 37 are provided in a printed-wiring board 34 formed with a microstrip 35, to surround a coupling region, as substitute for a part of the conductive wall 36 provided along the outer peripheral edge of the printed-wiring board in the first embodiment. As shown in FIG. 4, a dielectric waveguide 30 is fixed on the printed-wiring board 34 through a spacer 38 serving as a part of the conductive wall. The spacer 38 may be a member made of an electrically conductive material, or may be a member made of a resin material or a material for printed-wiring boards and formed to have an inner wall plated with a conductor. In either case, the point is to allow an opposed region between the slot and an open terminal end of the microstrip 35 is accommodated by the conductive wall 36.

Figure 5:
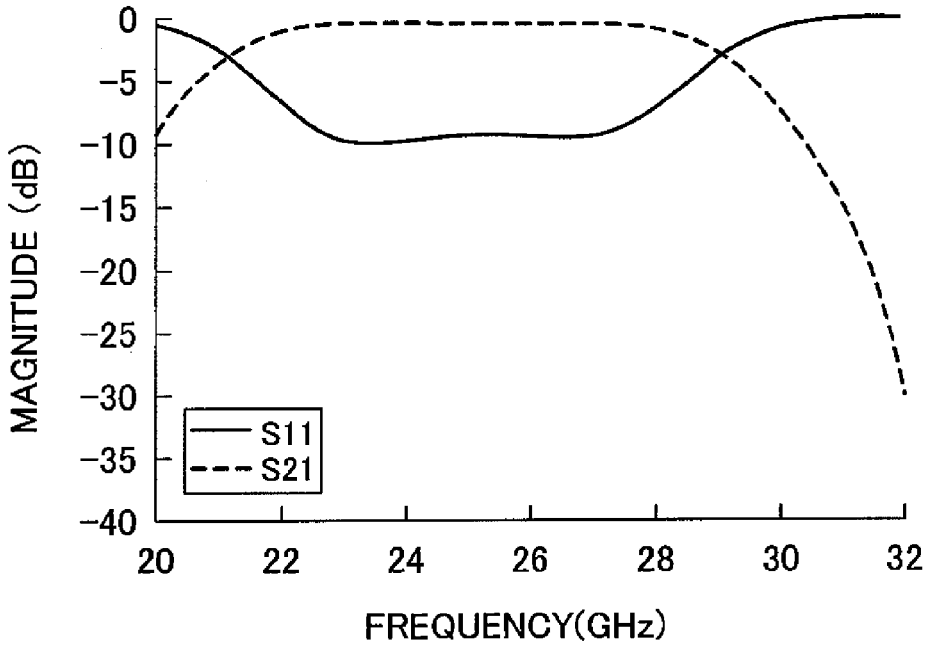
FIG. 5 is a graph showing a characteristic of the transition structure according to the second embodiment.

FIG. 5 shows a result obtained S-parameters by calculating an electromagnetic field intensity of the above transition structure using an electromagnetic field simulator. S11 is the return loss, and S21 is the transmission loss. In this calculation, a substrate having a thickness of 0.254 mm (relative permittivity: 2.2) was used as the printed-wiring board. Further, the dielectric waveguide was formed to have a cross-sectional size of 4.5 mm×2.5 mm (relative permittivity: 4.5), and fixed onto the printed-wiring board through the spacer formed to have a thickness of 0.4 mm. As seen in FIG. 5, the transition structure had a characteristic where a return loss is a magnitude of about 10 decibels (dB) in a frequency range of 23 GHz to 27 GHz.

Figure 6:
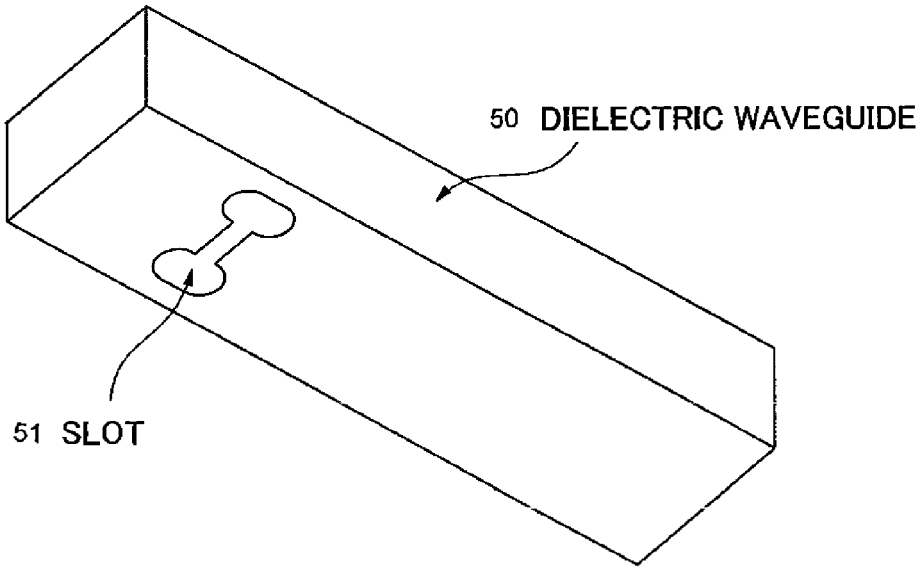
FIG. 6 is a perspective view showing a dielectric waveguide for use in a dielectric waveguide-microstrip transition structure according to a third embodiment of the present invention.
Figure 7:
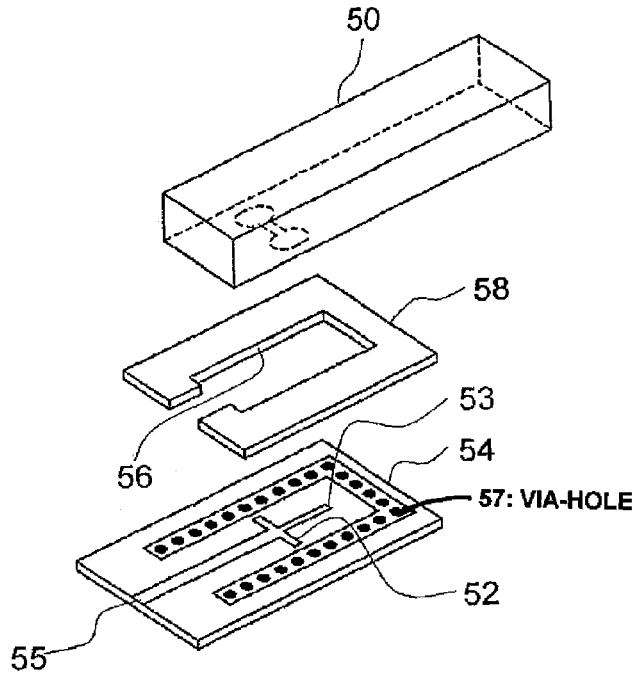
FIG. 7 is an exploded perspective view showing the dielectric waveguide-microstrip transition structure according to the third embodiment.
Figure 8:
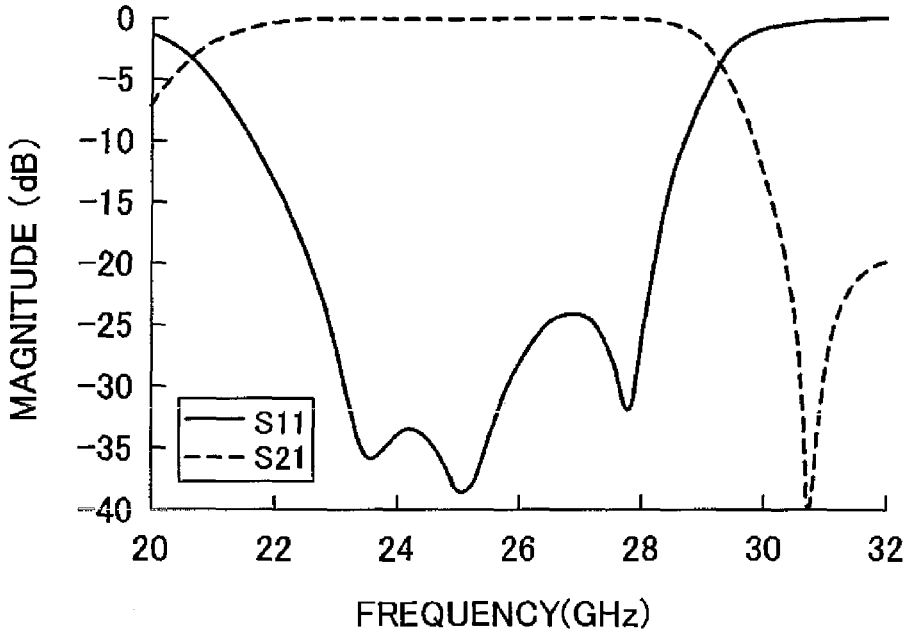
FIG. 8 is a graph showing a characteristic of the transition structure according to the third embodiment.

In view of obtaining wider-band transmission characteristics, and improved impedance matching, the slot 51 to be provided in the dielectric waveguide 50 may be formed in a dumbbell-like shape (generally H shape), as shown in FIG. 6. FIG. 7 shows a dielectric waveguide-microstrip transition structure according to a third embodiment of the present invention. As shown in FIG. 7, in view of impedance matching, a dielectric waveguide 50 is fixed on a printed-wiring board 54 through a spacer 58 serving as a part of the conductive wall 56, an array of via-holes 57 are provided in the printed-wiring board 54 formed with a microstrip 55, to surround a coupling region, as substitute for a part of the conductive wall 56, an open terminal end of the microstrip 55 in a coupling region is formed in a pattern which comprises a stub portion 52, and an edge portion 53 extending from the stub portion 52 by a distance of about a quarter wavelength and having a reduced line width, instead of the afore-mentioned simple shape. FIG. 8 shows a characteristic of the transition structure obtained by optimizing a shape of the slot and a shape of the terminal end of the microstrip, as shown in FIG. 7. This characteristic is a result of calculation using an electromagnetic field simulator. As seen in FIG. 8, a return loss S11 has a magnitude that is greater than 24 dB in a frequency range of 23 GHz to 28 GHz, which shows excellent impedance matching. An insertion loss S21 is also reduced to 0.3 dB or less.

Figure 9:
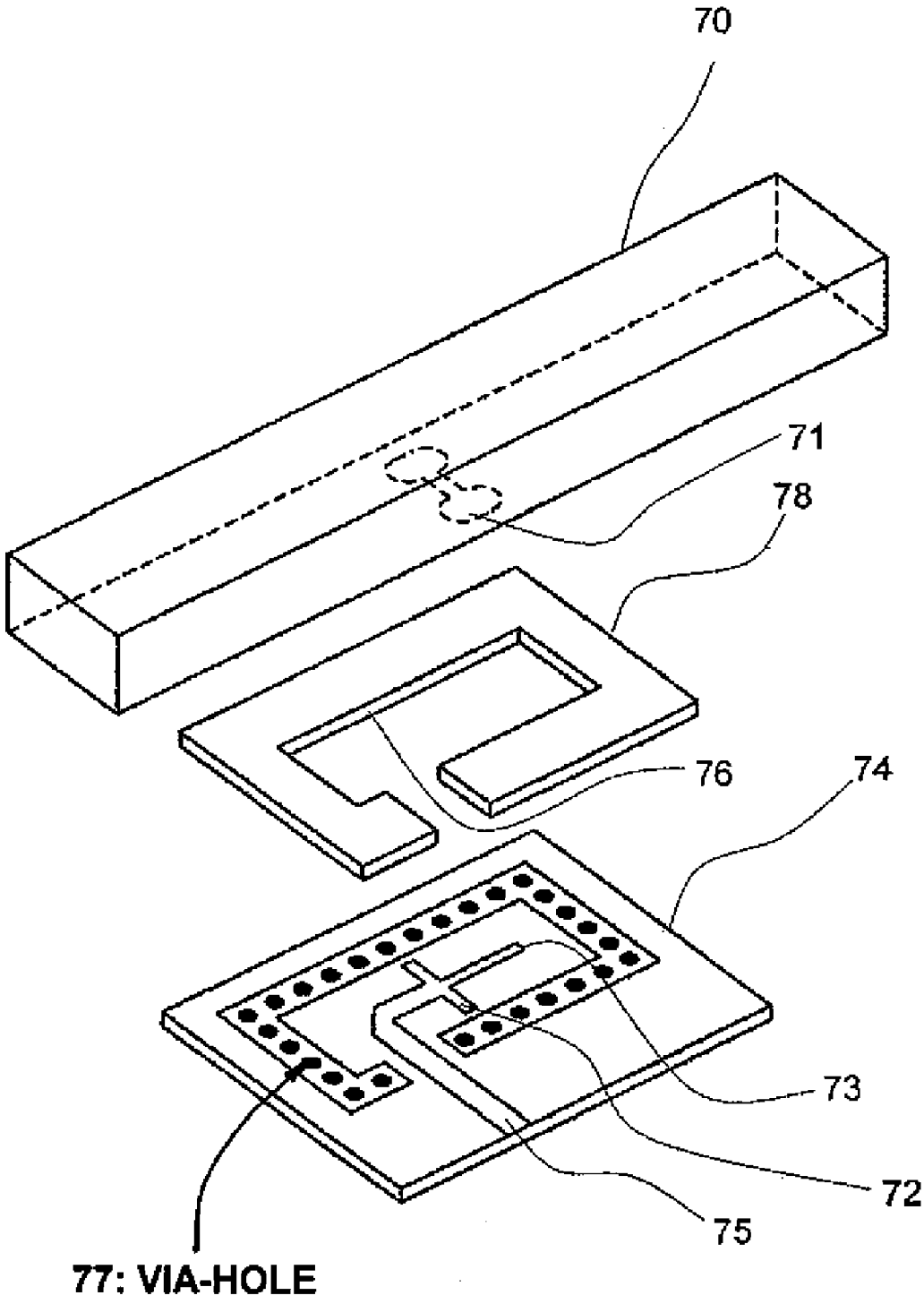
FIG. 9 is an exploded perspective view showing one example of modification of the dielectric waveguide-microstrip transition structure according to the third embodiment.

In each of the above transition structures, one of longitudinally opposite ends of the dielectric waveguide is terminated in a short-circuited manner. Alternatively, each of the ends may be used as an output port without being short-circuited, to allow the transition structure to serve as a branch circuit for distributing an electric power input from the slot. FIG. 9 shows a dielectric waveguide-microstrip transition structure according to another embodiment of the present invention. As shown in FIG. 9, in view of impedance matching, a dielectric waveguide 70 is fixed on a printed-wiring board 74 through a spacer 78 serving as a part of the conductive wall, an array of via-holes 77 are provided in the printed-wiring board 74 formed with a microstrip 75, to surround a coupling region, as substitute for a part of the conductive wall 76, an open terminal end of the microstrip 75 in a coupling region is formed in a pattern which comprises a stub portion 72, and an edge portion 73 extending from the stub portion 72 by a distance of about a quarter wavelength and having a reduced line width, instead of the afore-mentioned simple shape. The slot 71 in the bottom surface of the dielectric waveguide 70 can be formed in a symmetrical shape with respect to the two ports. Thus, as shown in FIG. 9, the slot 71 may be disposed at a laterally central position to allow an input from the slot 71 to be divided into halves, in a common phase.

The present invention can be widely used in various coupling structures, such as a coupling structure between a dielectric waveguide and an external circuit, and a branching filter, which are used in a high-frequency band.

The invention claimed is:

1. A dielectric waveguide-microstrip transition structure comprising:

a dielectric waveguide containing a dielectric block and a conductor film covering an entire surface of the dielectric block, except a signal input/output portion, an H shaped slot being formed in the conductor film at a bottom surface of the dielectric waveguide to expose the dielectric block;

a microstrip having an end portion which is openly terminated in an open circuit and disposed opposing to and spaced apart from H shaped slot of the dielectric waveguide, the end portion being branched and being formed in a pattern which comprises respective stub portions on both sides of the microstirp, an edge portion extending from said stub portions in a direction of the microstrip by a distance of about a quarter wavelength and having a reduced line width as compared to a line width of the microstrip to achieve impedance matching with the H shaped slot; and a cavity containing a conductive wall surrounding the end portion of the microstrip and the H shaped slot of the dielectric waveguide, except a part of the microstrip extending out of the cavity to an external circuit.

2. The dielectric waveguide-microstrip transition structure as defined in claim 1, wherein:

the microstrip is provided on a printed-wiring board; and the cavity is formed by connecting a portion of the conductor film, surrounding a periphery of the microstrip, to a back surface of the printed-wiring board through a via-hole, and disposing a conductive plate spacer having a void in a position opposing to the slot between the dielectric waveguide and the printed-wiring board.

3. A branch circuit having a dielectric waveguide-microstrip transition structure according to claim 1.

4. The dielectric waveguide-microstrip transition structure as defined in claim 1, wherein the microstrip is provided on a printed-wiring board, and the cavity is formed by connecting a portion of the conductor film, surrounding a periphery of the microstrip, to a back surface of the printed-wiring board through a via-hole.

* * * * *